United States Patent [19]

Brown et al.

[11] 4,205,777

[45] Jun. 3, 1980

[54] BOXES OR PACKS FOR PACKAGING EGGS, FRUIT OR OTHER ARTICLES

[76] Inventors: William R. Brown, "The Birches" Lower Broad Oak Rd., West Hill, Ottery St. Mary, Devonshire; Harold W. Caddy, 61 Stafford Rd., Bridgwater, Somerset, both of England

[21] Appl. No.: 20,013

[22] Filed: Mar. 13, 1979

[30] Foreign Application Priority Data

Mar. 16, 1978 [GB] United Kingdom ..... 10446/78

[51] Int. Cl.[2] ..... B65D 5/66; B65D 1/24

[52] U.S. Cl. ..... 229/44 EC; 229/2.5 EC

[58] Field of Search ..... 229/2.5 EC, 29 M, 44 R, 229/44 EC

[56] References Cited

U.S. PATENT DOCUMENTS

| | | | |
|---|---|---|---|
| 2,974,842 | 3/1961 | Reifers | 229/29 M X |
| 3,131,846 | 5/1964 | Whiteford | 229/29 M |
| 3,421,682 | 1/1969 | Eisenbach | 229/2.5 EC X |
| 3,447,731 | 6/1969 | Lehmann | 229/2.5 EC |
| 3,596,822 | 8/1971 | Holley | 229/44 R X |
| 3,655,110 | 4/1972 | Eisenbach | 229/25 EC |
| 3,661,317 | 4/1972 | Noguchi | 229/29 M X |
| 3,771,712 | 11/1973 | Richards | 229/2.5 EC X |
| 3,933,296 | 1/1976 | Ruskin et al. | 229/29 M X |
| 4,025,038 | 4/1977 | Reifers et al. | 229/44 EC X |
| 4,057,188 | 11/1977 | Steinhardt | 229/29 M |

FOREIGN PATENT DOCUMENTS

| | | | |
|---|---|---|---|
| 1341984 | 9/1963 | France | 229/29 M |

*Primary Examiner*—Davis T. Moorhead

*Attorney, Agent, or Firm*—Brisebois & Kruger

[57] ABSTRACT

An eggbox, which is a one-piece moulding of plastics sheet material, comprises a base part having egg-receiving pockets and a cover part having corresponding pockets hinged together along mutually adjacent rims so that the cover part can be folded over the base part to close the latter. In the closed position, the parts are fastened together at their rims opposite the hinge by cooperating studs and slots formed respectively on the two parts. The slots are of key-hole shape and, when the cover part is closed, the studs initially engage in the wider portions of the slots and are urged into engagement with the narrower portions by the inherent resiliency of the parts in order to fasten the parts together. A second set of cooperating studs and slots, which interengage in the manner of press-stud fasteners, are formed centrally of the base and cover parts in order to assist in fastening the parts together.

10 Claims, 5 Drawing Figures

Figure 1:
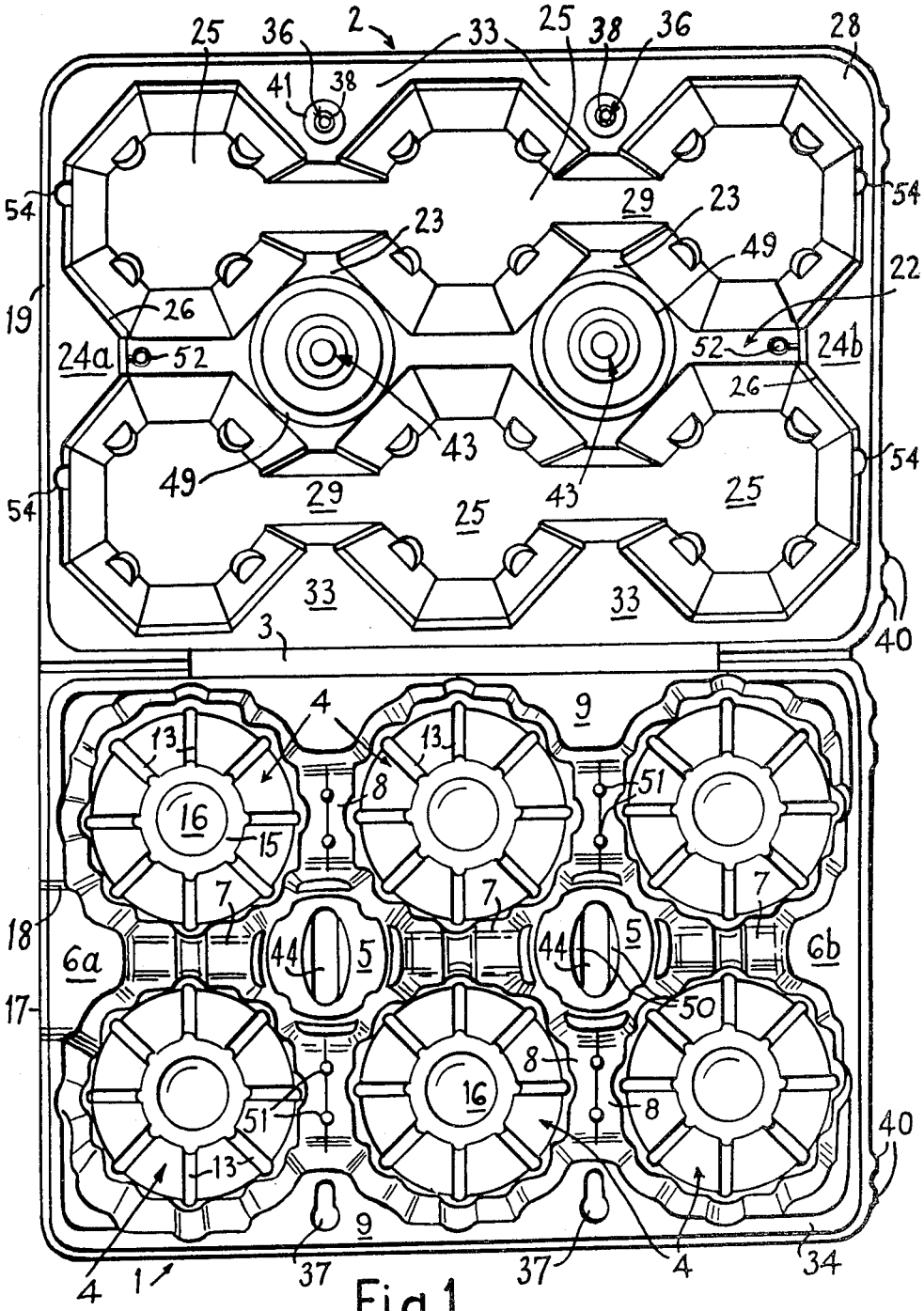

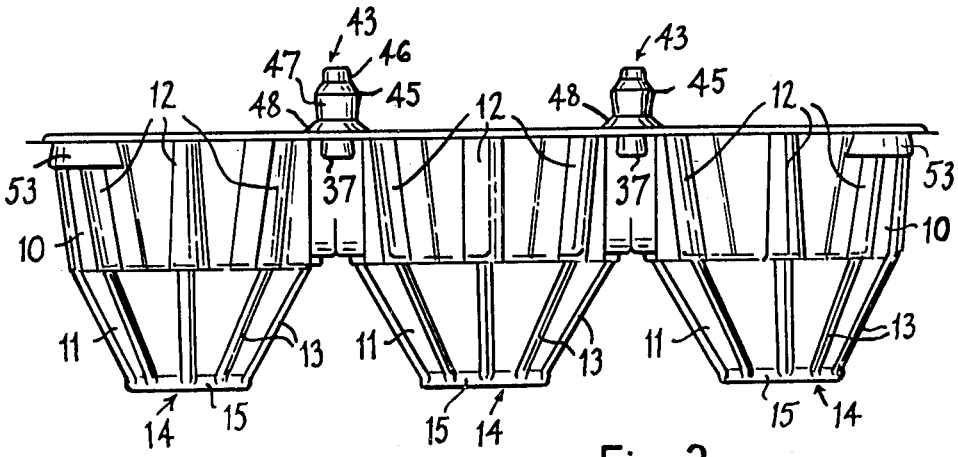
Fig.3
Fig.4
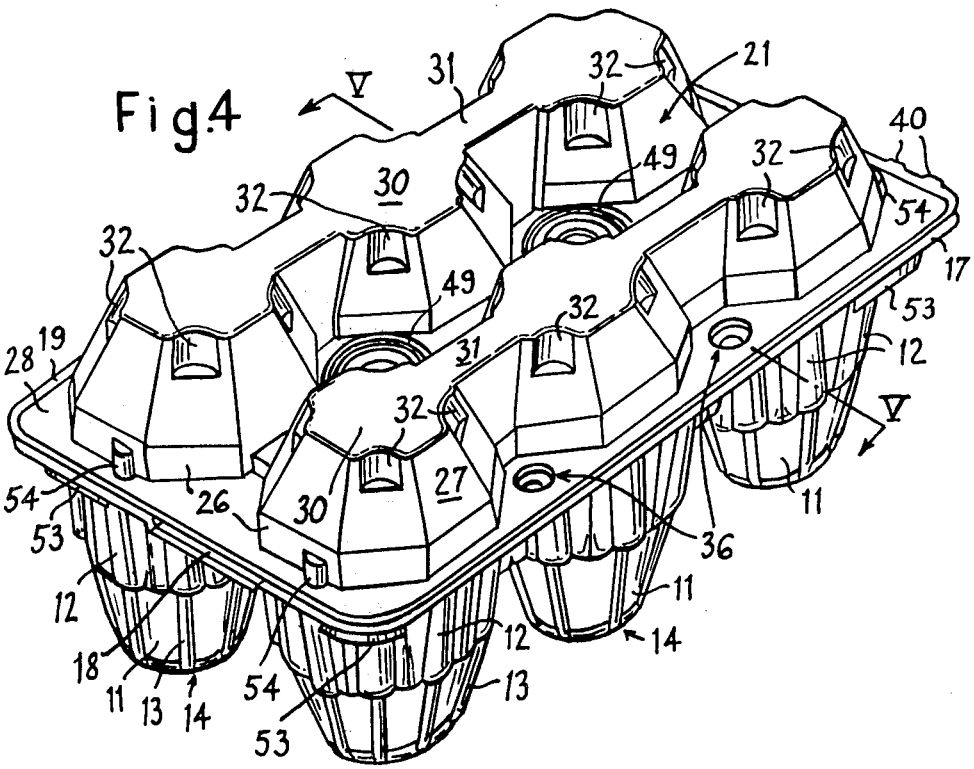

BOXES OR PACKS FOR PACKAGING EGGS, FRUIT OR OTHER ARTICLES

The present invention relates to boxes or packs for packaging eggs, fruits or other articles and, more particularly, to such boxes or packs of the type in which a base part having mutually parallel rows of article-receiving pockets is formed in one piece with a hollow cover part, the parts being hinged together along mutually adjacent rims, substantially parallel to the rows of article-receiving pockets, so that the cover part can be folded about the hinge from an open position to a closed position in which it is inverted over the base part and closes the open, upper ends of the pockets therein. Conveniently, the boxes may be thermo-formed from plastics sheet material. The base and cover parts of such plastics boxes are commonly formed with press-stud type fastening device for fastening the parts together in their closed position.

Plastics eggboxes of the type described above are nowadays packed and closed by automatic machinery. The empty eggboxes are delivered to the machinery in a stacked condition, that is, stacked one on top of the other in an open position with their base and cover parts respectively internested. The machinery destacks or denests the boxes, conveys them in succession to an egg packing or filling unit, which deposits eggs in the article-receiving pockets of the base parts, and thereafter conveys the filled boxes to a closing unit which engages under the top of the cover part, swings the latter into its inverted, closed position and, at the same time, exerts a downward force on the top of the cover part to engage the press-stud fasteners which fasten the base and cover parts together.

It has been found that the press-stud type fastening devices with which plastics eggboxes have hitherto been moulded are not always closed by the closing unit of the packing machinery. In closing the cover part of an eggbox the closing unit tends to distort the cover part transversely of the base part so that the male and female elements of the fasteners do not always coincide and sometimes fail to engage. Moreover, designs of press-stud fasteners hitherto used in eggboxes are apt to vary in effectiveness from difficult to close and open, to a too easy fit with poor closure retaining properties. This is mainly because of the close tolerances to which the male and female elements of a fastener must be formed in order to produce a satisfactory closure and, additionally, because of unavoidable production thickness variations in the thermoplastic sheet material from which boxes are formed.

It is an object of the present invention to overcome the above mentioned problems experienced with prior fastening devices used for eggboxes or packs and, in particular, to provide an eggbox or pack of the type referred to which may be consistently closed and fastened by the automatic closing units employed in egg packing lines and in which the fastening devices do not require to be made to such close tolerances as hitherto. The invention consists in a box or pack of the type referred to, in which the cover part is fastened in its closed position by one or more cooperating studs and slots formed respectively on the two parts adjacent their rims opposite the hinge, the or each slot extending transversely to the axis of the hinge and being wider at or adjacent one end, whereby when the cover part is closed, the cooperating stud is initially insertable into the wider portion of the slot and is urged into engagement with the narrower portion by the inherent resiliency of the base and cover parts in order to fasten the two parts in the closed position.

Preferably, the or each slot is of generally key-hole shape and the or each stud comprises a head portion, which is a clearance fit in the wider portion of the key-hole slot, and a groove or undercut formed below the head which is engageable with the narrower portion of the slot. Also preferably, the or each stud is located on the cover part and the or each cooperating slot is located on the base part with the wider portion of the slot disposed towards the adjacent rim of the base part.

The cover part is advantageously formed externally, with at least one channel-like recess which extends from one end of the cover part to the other, parallel to the hinge, and is disposed centrally of the cover part in a position which is between the article-receiving pockets in the base part, when the cover is closed, thereby to facilitate flexing of the cover part parallel to the hinge and engagement and release of the cooperating stud(s) and slot(s).

On opposite sides of this channel-like recess, the cover part may be formed with pockets, corresponding to the pockets in the base part, for receiving the upper ends of articles disposed in the base pockets. The pockets in each row on the cover part may have substantially flat areas, at and adjacent their upper ends, extending along opposite sides of the recess. These flat areas provide a convenient place on which to print or otherwise reproduce the supplier's name or advertising or other matter.

In a preferred embodiment, hollow posts are formed between the rows of article-receiving pockets in the base part and these posts are disposed opposite the bottom of the hollow partition formed on the inside of the cover part by the channel-like recess thereof. The posts and partitions are formed with a second set of one or more cooperating studs and slots which, when the cover part is closed, interengage in the manner of press-stud fasteners to assist in fastening the cover part in its closed position. The or each slot of this second set also extends transversely to the axis of the hinge between the base and cover parts and has generally parallel transversely extending sides. The or each cooperating stud is formed with a groove or undercut which engages with the sides of the slot when the stud is pressed into engagement therewith. Conveniently, two or more of these studs are located on the bottom of the hollow partition on the cover part whilst cooperating slots are located in the posts. The or each stud may be provided with a lead-in taper and the sides of the cooperating slot may be bevelled so as to facilitate engagement. Because the female part of this second fastening comprises a slot also extending transversely to the axis of the hinge, this fastening is able to accomodate any distortion of the cover part upon closing thereof by an automatic closing unit.

During an egg packing process, the stacked eggboxes may be denested twice. That is, firstly, to permit printing of information on the outside of each box, whereafter the boxes are restacked, and secondly, for the actual packing or filling operation. It is therefore important that the boxes are designed so as to facilitate separation of individual boxes from a stack, and to this end, the base part is advantageously formed at its four corners with outwardly diverging stacking ledges whilst the cover part has outwardly diverging stacking projections formed on its sides at opposite ends of the hinge. A set of several moulds for forming the eggboxes may be adapted to mould the stacking projections on the cover parts in different positions along the sides of the eggboxes so that the stacking projections on adjacent cover parts in a stack are unlikely to coincide, The stacking shoulders and projections rest on the rim of a like box within which the box is nested to prevent or resist the nested parts from wedging or jamming together and thereby facilitate separation of the boxes by the mechanical separating device of the automatic printing and packing machinery.

Figure 2:
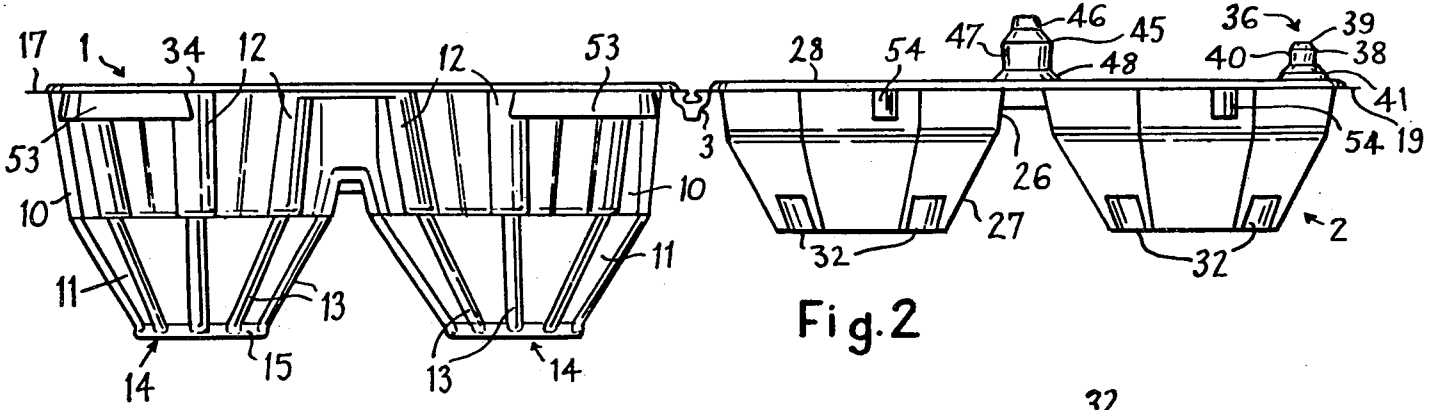
Figure 5:
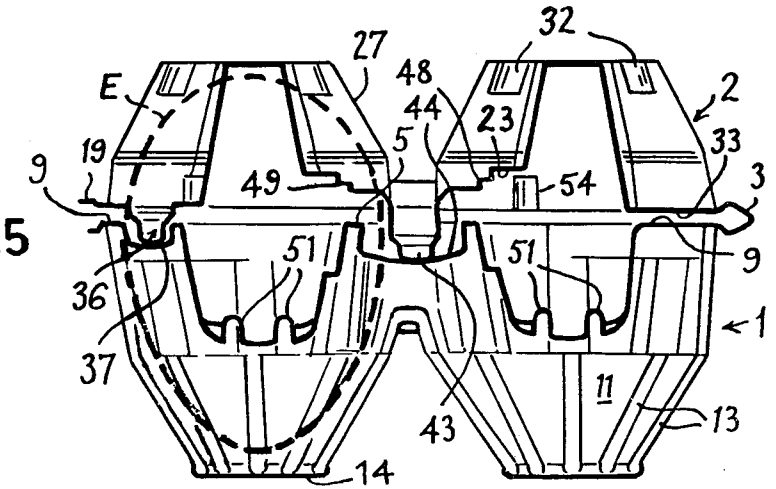

In order that the present invention may be more readily understood, reference will now be made to the accompanying drawings, in which:

FIG. 1 is a plan view of an eggbox constructed in accordance with the invention shown in the fully open position, FIG. 2 is an end view of the open eggbox shown in FIG. 1, FIG. 3 is a side view of the open box, FIG. 4 is a perspective view of the box shown in FIG. 1, when closed, and FIG. 5 is a transverse section through the closed box taken along the line V—V of FIG. 4.

Referring to the drawings, the eggbox is a one-piece moulding of plastics sheet material. For example, conveniently it is fluid pressure-formed or vacuum formed from high impact polystyrene sheet material. It comprises a base part 1 and cover part 2 both of generally rectangular shape in plan and joined together along mutually adjacent longitudinal rims by integral web portions serving as a hinge 3 about which the cover part may be folded over the base part. In the preferred form of the invention used for packaging eggs, the package comprises two such boxes formed as an integral unit and joined together at mutually adjacent ends by small spaced plastics webs 40 (FIG. 1) which provide a line of weakness along which the package can be readily split into its two component boxes each containing, for example, six eggs. The two component boxes are mirror images of one another and therefore only one box is illustrated and will be described in detail.

The base part 1 comprises six egg-receiving pockets 4 disposed in two mutually parallel rows extending longitudinally of the base part, that is, parallel to the axes of the hinge formed by the web portions 3, with the pockets of the two rows arranged side-by-side. The two rows of pockets 4 are separated from one another by hollow posts 5 moulded at the centre of each array of four adjacent pockets, hollow half-posts **6*a*, 6*b* between the rows at opposite ends of the base part, and hollow partitions 7 interconnecting the posts and half-posts. Adjacent pockets in each row are separated from one another by transverse hollow partitions 8 which join the posts 5 to hollow half-posts 9 formed in the side walls of the base part. The walls of the posts, half-posts, partitions, side walls and end walls of the base part are so shaped that each pocket 4 is of generally circular shape in section and is formed by upper and lower merging conical frustra 10, 11. The upper frustrum 10 has a nearly vertical conical wall structure, inclined only slightly downwardly and inwardly, whilst the conical wall of the lower frustrum 11 has a greater inclination than that of the upper frustrum. Formed on the exterior of the upper frustrum are wide, hollow, axial ribs 12. These ribs terminate at the joint between the upper and lower frustra and the latter is formed with a narrower set of hollow axial ribs 13 which extend from the joint to the closed bottom 14 of the pocket. These two sets of ribs 12, 13 serve to stiffen the pocket and act as cushions to protect the eggs against side blows or shocks. The closed bottom 14 of the pocket is formed with an external hollow annular boss 15, the centre of which is closed by a bottom wall portion 16 slightly domed outwardly. This construction serves as a protective cushion for the bottom of an egg and to stiffen the closed bottom of the pocket. An egg E (shown in broken lines FIG. 5) disposed in a pocket tends to seat on the side walls of the pocket and does not normally rest on the bottom 14**.

A stiffening flange 17 is formed about the rim of the base part. Along the side connected to the cover part, this flange is integral with the web portions 3 forming the hinge. The post **6*a* and the integral portion of the flange 17, at the free end of the base part, form a depression 18** in the rim of the base part which provides a ventilating opening between the cover and the base parts when the cover part is closed.

The cover part 2 is hollow and, in the embodiment illustrated, its depth is approximately one-third of the overall depth of the closed box. The base part is made deeper than the cover part so as to provide better retention of the eggs when they are deposited into the base part by an egg packing machine. The cover part is deep enough to accomodate the projecting top portions of eggs seated in the pockets 4 when it is folded about the web hinge 3 into an inverted, closed position over the base part, as shown in FIG. 5. A stiffening flange 19, similar to the flange 17, if formed about the rim of the cover part, this flange also being integral with the web hinge 3.

The top of the cover part has a channel-like recess 21 formed in its outside which extends longitudinally along the central section of the cover from one end to the other and project inwardly of the cover part so as to form a hollow longitudinal partition 22 on the inside of the cover part in line with the posts 6, 7, when the cover is closed. The partition includes posts 23 and half-posts **24*a*, 24*b* which project into the cover part for the full depth of the latter and the bottoms of these posts and the half-posts 24*b* are engageable with tops of the posts 5 and the half-posts 6*b* when the cover is closed over the base part. The partition 22, sides and ends of the cover part are so shaped and arranged as to define individual pockets 25 in the cover part which cooperate respectively with the artcile-receiving pockets 4 of the base part and contain the upper ends of eggs disposed in the base part. Each of the pockets 25 in the cover part is of generally octagonal shape in plan and is formed by lower and upper merging octagonal frustra 26, 27. The lower frustrum 26 which projects upwardly from planar marginal portions 28 of the cover part has nearly vertical side walls inclined only slightly upwardly and inwardly, whilst the side walls of the upper frustrum 27 are of greater inclination. The pockets 25 in each row are interconnected by passages 29 and the tops or upper ends 30 and 31 of the pockets and passages are substantially flat so as to provide flat areas on opposite sides of the recess which can be printed with selected information, advertising and/or decorative matter. Small rebates 32 are moulded in some of the pocket walls at equally spaced positions about the tops of the pockets 25 and these rebates serve to form abutments on the insides of the pockets 25** which engage eggs contained in the box and restrain them from contacting the top of the cover.

When the cover part 2 is closed (FIG. 5), the bottom of the posts 25, the half-posts 24*a*, 24*b* and further half-posts 33 formed in the longitudinal sides of the cover part between the pockets 25, and the interconnecting planar marginal portions 28 of the cover part can engage the posts 5, the half-posts 6*b*, 9 and opposing flat surfaces 34 of the base part in order to increase the area of support of the cover part on the base part and, thereby, the resistance of the cover to collapse.

On the inside of the cover part, the half-posts 33 adjacent the rim opposite the hinge 3 are formed with small downwardly projecting studs 36 which are arranged to engage in cooperating slots 37 in the tops of the opposing half-posts 9 in the base part, when the cover part is closed (FIGS. 2 and 5). The slots 37 extend transversely to the axis of the hinge 3 and are of generally key-hole shape. Each stud 26 is of circular-cross section and has a head 38 which has a small lead-in taper 39 and is of slightly smaller diameter than the wider portion of the cooperating key-hole slot 37 so as to be a clearance fit therein. Below the head 38, the stud is formed with an annular undercut 40 and is joined to the adjacent half-post 33 by a configured portion 41 which is adapted to enhance the rigidity of the stud. The annular undercut 40 in the stud has a diameter approximating the width of the narrower portion of the cooperating key-hole slot 37. The relative dispositions of the studs and slots is such that, when the cover part is hinged into its closed position without any transverse distortions of the parts, the heads of the studs coincide with the narrower portions of the slots. In order to engage the studs and slots and fasten the cover part in its closed position, it is necessary slightly, transversely to distort the cover part towards the outer ends of the key-hole slots, as occurs when the cover part is automatically closed by the automatic closing unit in an egg packing line. The heads of the studs then engage in the wider portions of the key-hole slots and, when the box is released by the closing unit the inherent resiliency of the box tends to restore the cover part to its undistorted position and, hence, urges the studs into the narrow portions of the slots, whereupon the undercut portions 40 engage with the edges of the slots to fasten the cover part closed.

The slots 37 are, in fact, formed as cavities to facilitate moulding and the walls of the cavities below the upper edges, which define the slots, are tissue thin and do not resist movement of the heads 38 of the studs, nor restrain the studs from engaging the narrower portions of the slots.

The bottoms of the posts 23 are also formed with studs 43 which are arranged to engage in cooperating slots 44 in the tops of the opposing posts 5, when the cover part is closed (FIGS. 2, 3 and 5). The studs 43 are of similar shape to the studs 36 but are of overall larger diameter. Each stud comprises a head 45 having a tapered lead-in portion 46 and an annular undercut 47 below the head, and is joined to the adjacent post 23 via an inclined or radiused portion 48. Each post 23 has a step configuration 49 at its periphery adjacent the stud. The purpose of the inclined portion and the step configuration is to enhance the rigidity of the stud. The cooperating slots 44 in the posts 5, similarly to the key-hole slots 37, extend transversely to the axis of the hinge 3. The opposite longitudinal sides of each slot 44, are spaced apart by a distance less than the maximum diameter of the head of the cooperating stud 43, and have bevelled edges 50 which cooperate with the lead-in taper 46 of the stud to facilitate engagement of the head through the slot 44, opposite sides of which engage with the annular undercut 47 in the stud. Hence, when the cover 2 is closed so as to engage the studs 36 and the key-hole slots 37, the studs 43 snap-fit into engagement with the slots 44, in the manner of press-stud fasteners, in order to assist in fastening the cover in its closed position. The slots 44 permit the studs 43 to move transversely upon distortion of the cover part so as not to resist movement of the studs 36 into engagement with the key-hole slots 37. Similarly to the latter, the slots 44 are formed as cavities in order to facilitate moulding, but the walls of the cavities below the upper edges of the slots are tissue thin and do not resist movement of the stud heads.

When the box is to be opened, the two sets of studs and slots 36, 37 and 43, 44 can be disengaged by gripping the base part of the box and applying a manual force to the rim of the cover part so as to distort the rim transversely away from the hinge 3 and move the studs 36 into the wider portions of the key-hole slots 37, whereupon the cover can be hinged to its open position, at the same time, withdrawing the studs 43 from the slots 44. The channel-like recess 21 in the cover part permits the cover part to be flexed about an axis parallel to the axis of the hinge 3, thereby facilitating disengagement of the studs and slots. It is a simple matter manually to reclose the box, if desired, firstly by moving the cover part to engage the studs 43 and then flexing the outer part of the cover so as to engage the studs 36.

In order to assist in keeping apart the eggs contained in the box and prevent them from bumping and banging together with consequent cracking or breakages, pairs of hollow spacer pegs 51 are moulded on the partitions 8 of the base part, whilst hollow spacer pegs 52 are moulded adjacent opposite ends of the partition 22 on the cover part. These pegs are interconnected to adjacent posts or half-posts by stiffening webs.

For the purpose of storage, transportation and feeding into automatic printing and egg packing machinery, the boxes are stacked in the fully open condition, as shown in FIG. 2, with their base parts 1 respectively nested one within another and their cover parts 2 respectively nested. In order to facilitate destacking of the nested boxes by mechanical separating devices, each base part is provided at its four corners with stacking ledges 53 whilst each cover part is formed with stacking projections 54 at opposite ends of each row of pockets therein. The stacking ledges 53 and projections 54 diverge downwardly from the rims of the parts at an angle of approximately 6° and when stacked, the ledges and projections on the two parts of one box rest on the rims of the parts within which they are nested in order to prevent the parts from wedging or jamming together.

Whilst a particular embodiment has been described it will be understood that modifications can be made without departing from the scope of the invention as defined by the appended claims. For example, the eggbox may be constructed so as to contain a different quantity of eggs.

We claim:

1. A box or pack for packaging eggs, fruit or other articles, in which a base part having mutually parallel rows of article-receiving pockets is formed in one piece with a hollow cover part, the parts being hinged together along mutually adjacent rims substantially parallel to the rows of article-receiving pockets so that the cover part can be folded about the hinge from an open position to a closed position in which it is inverted over the base part and closes the open, upper ends of the pockets therein, characterised in that the cover part is fastened in its closed position by one or more cooperating studs and slots formed respectively on the two parts adjacent their rims opposite the hinge, the or each slot extending transversely to the axis of the hinge and being wider at or adjacent one end, whereby when the cover part is closed, the cooperating stud is initially engageable with the wider portion of the slot and is urged into engagement with the narrower portion by the inherent resiliency of the base and cover parts in order to fasten the two parts in the closed position.

2. A box or pack as claimed in claim 1, characterised in that the or each slot is of generally key-hole shape and the or each stud comprises a head portion which fits into the wider portion of the key-hole slot, and a groove or undercut below the head which is engageable with the narrower portion of the slot.

3. A box or pack as claimed in claim 1 or 2, characterised in that the or each stud is located on the cover part and the or each cooperating slot is located on the base part with the wider portion of the slot disposed towards the adjacent rim of the base part.

4. A box or pack as claimed in claim 1, 2 or 3, in which the cover part has a channel-like recess externally thereof and extending from one end of the cover part to the other substantially parallel to the axis of the hinge, said recess being disposed centrally of the cover part in a position which is between the article-receiving pockets in the base part, when the cover part is closed, thereby to facilitate flexing of the cover part parallel to the hinge and engagement and release of the cooperating stud(s) and slot(s).

5. A box or pack as claimed in claim 4, characterised in that the cover part is formed on opposite sides of the channel-like recess with pockets corresponding to the pockets in the base part for receiving the upper ends of articles disposed in the base pockets.

6. A box or pack as claimed in claim 5, characterised in that the pockets in each row of the cover part have substantially flat areas at and adjacent their upper ends extending along opposite sides of the recess in the cover part.

7. A box or pack as claimed in claim 6, characterised in that hollow posts are formed between the rows of article receiving pockets in the base part and are disposed opposite the bottom of the hollow partition formed on the inside of the cover part by the channel-like recess, and in that the posts and partition are formed with a second set of one or more cooperating studs and slots which, when the cover part is closed, interengage in the manner of press-stud fasteners, to assist in fastening the cover part in its closed position.

8. A box or pack as claimed in claim 7, characterised in that the or each slot of the second set extends transversely to the axis of the hinge between the parts and has substantially parallel transversely extending sides, and in that the or each cooperating stud is formed with a groove or undercut which engages with the sides of the slot when the stud is pressed into engagement therewith.

9. A box or pack as claimed in any one of the preceding claims, which is formed from deep drawn plastics foil material and characterised in that the or each slot is of such a draw depth as to have tissue thin side walls and bottom walls.

10. A box or pack as claimed in any one of the preceding claims, characterised in that the depths of the base and cover parts are approximately two-thirds and one-third the overall depth of the closed box, respectively.

* * * * *